United States Patent [19]

Peterson et al.

[11] 4,279,533

[45] Jul. 21, 1981

[54] ROADWAY EXPANSION JOINT

[75] Inventors: Charles M. Peterson, Franklin; Frank M. Lymburner, Romeo, both of Mich.

[73] Assignee: Harry S. Peterson Co., Inc., Pontiac, Mich.

[21] Appl. No.: 122,920

[22] Filed: Feb. 20, 1980

[51] Int. Cl.[3] ..... E01C 11/06; E01C 11/12

[52] U.S. Cl. ..... 404/68; 404/74

[58] Field of Search ..... 404/68, 74, 53, 54, 404/47, 67, 69; 14/16.5; 52/396

[56] References Cited

U.S. PATENT DOCUMENTS

| | | | |
|---|---|---|---|
| 2,220,628 | 11/1940 | Stedman | 404/47 |
| 3,430,544 | 3/1969 | Berks | 14/16.5 X |
| 3,520,236 | 7/1970 | Sequaris | 404/69 |
| 3,555,982 | 1/1971 | George | 404/69 |
| 3,595,142 | 7/1971 | Via | 404/49 |
| 3,722,379 | 3/1973 | Koester | 404/74 X |
| 3,790,294 | 2/1974 | Trieste | 404/68 |
| 3,810,707 | 5/1974 | Tungseth et al. | 404/74 X |
| 3,849,958 | 11/1974 | Balzar et al. | 52/396 |
| 3,974,609 | 8/1976 | Attaway | 404/68 X |
| 4,015,302 | 4/1977 | Clark | 404/69 |

FOREIGN PATENT DOCUMENTS

| | | | |
|---|---|---|---|
| 565284 | 8/1975 | Switzerland | 404/69 |

*Primary Examiner*—Rodney H. Bonck

*Attorney, Agent, or Firm*—Reising, Ethington, Barnard, Perry & Brooks

[57] ABSTRACT

A roadway sealed expansion joint between roadway sections spaced by an expansion slot, the roadway sections having recesses adjacent and extending longitudinally of the slot. A metal plate bridges the slot and is secured to the bottom of the recess in one of the sections and is movable relative to the bottom of the recess in the other of the sections. Overlying the metal plate is a unitary elastomeric slab with its upper surface aligned with the upper surfaces of the concrete sections and with its edges bonded to the sides of the recesses, this elastomeric slab having a center premolded portion of relatively high elasticity and edge portions which are molded in situ and which are of relatively low elasticity.

13 Claims, 2 Drawing Figures

ROADWAY EXPANSION JOINT

TECHNICAL FIELD

The subject matter of the present invention is a roadway expansion joint which enables adjacent concrete roadway sections separated by an expansion slot to expand and contract and which effectively prevents water and debris on the roadway surface from entering the expansion slot. The invention finds its chief utility in bridges and other elevated roadways and in multilevel concrete parking decks.

BACKGROUND ART

Concrete roadways are made with concrete sections separated from each other by expansion slots to enable thermal expansion and contraction of the roadway. In ordinary surface roads slots can simply be filled with resilient bituminous material or the like. However, for bridges and other elevated roadways and multilevel concrete parking decks other more elaborate means is required to effectively and durably fill and seal the slots, at the same time enabling expansion and contraction of the adjacent concrete sections due to changes in temperature.

Numerous preformed rubber or other elastomeric sealing members, molded to various configurations, have been proposed for use in the expansion slots, such premolded member being mechanically secured within the slots as by bolts or the like. It is also known to recess the edges of the concrete sections adjacent the expansion slot and then secure the elastomeric member into the slot by placing it with its edges in the recesses and then securing it in place by filling the recesses with a resin-modified concrete or the like. The chief difficulty with all such structures is that they lack durability and after a relatively short period cease to provide an effective seal and with this, in turn, leading to deterioration of the entire joint structure.

It is also known to use a metal plate to bridge the expansion slot, the plate being secured to the recess in one of the concrete sections and being movable relative to recesses in the other of the concrete sections, and with the recess portions above the metal plate then being filled with an elastomeric material which is molded in situ, and with a thin layer of material being used between the metal plate and the molded in situ elastomer to inhibit bonding of the elastomer to the metal plate thereby enabling relative movement therebetween. However, such structure is very demanding of close quality control in construction and requires compromise in the choice of the elastomer material. Further, even with optimum choice of material and optimum quality control in construction, such structure nevertheless is lacking in long term durability to assure continued effective sealing of the expansion slot.

DISCLOSURE OF INVENTION

In accordance with the present invention, a metal plate is used to bridge the expansion slot, such metal plate being secured to the edge recess in one of the concrete sections and being movable relative to the edge recess on the other concrete sections, and the remainder of the recesses is filled with a unitary elastomeric slab with its upper surface coplanar with the roadway surface and with its edges bonded to the side surfaces of the recesses, this unitary systematic slab having a premolded center portion extending longitudinally of and overlying the metal plate and being of relatively high elasticity, and edge portions which are molded in situ and which are of relatively low elasticity. Hence, the unitary elastomeric slab is of composite composition, the center portion of the slab being relatively soft, or of high elasticity, and the edge portions which border and are bonded to the concrete being relatively hard. The premolded center portion of the unitary elastomeric slab imparts ample elasticity to the total of the slab to enable the necessary compaction and elongation thereof during thermal expansion and contraction of the concrete sections, and the relatively hard molded in situ edge portions of the slab which join to the concrete are able to withstand the gaff of automobile wheels hitting the bonded junction between the elastomeric slab and the concrete. Further, such structure with all its advantages can be provided at relatively low cost and with excellent quality control, this by reason of the fact that the center portion of the unitary elastomeric slab is premolded to the precise uniform thickness desired and the edge portions are, after the premolded center portion is located over the metal plate in the roadway joint, molded in situ between the sides of the recesses and the premolded center portion. This method enables simple relatively low cost installation and yet with the complete installation providing an extremely durable joint effectively sealed against water and roadway debris.

Other objects, features and advantages of the invention will appear more clearly from the following detailed description thereof.

BEST MODE FOR CARRYING OUT THE INVENTION

Figure 1:
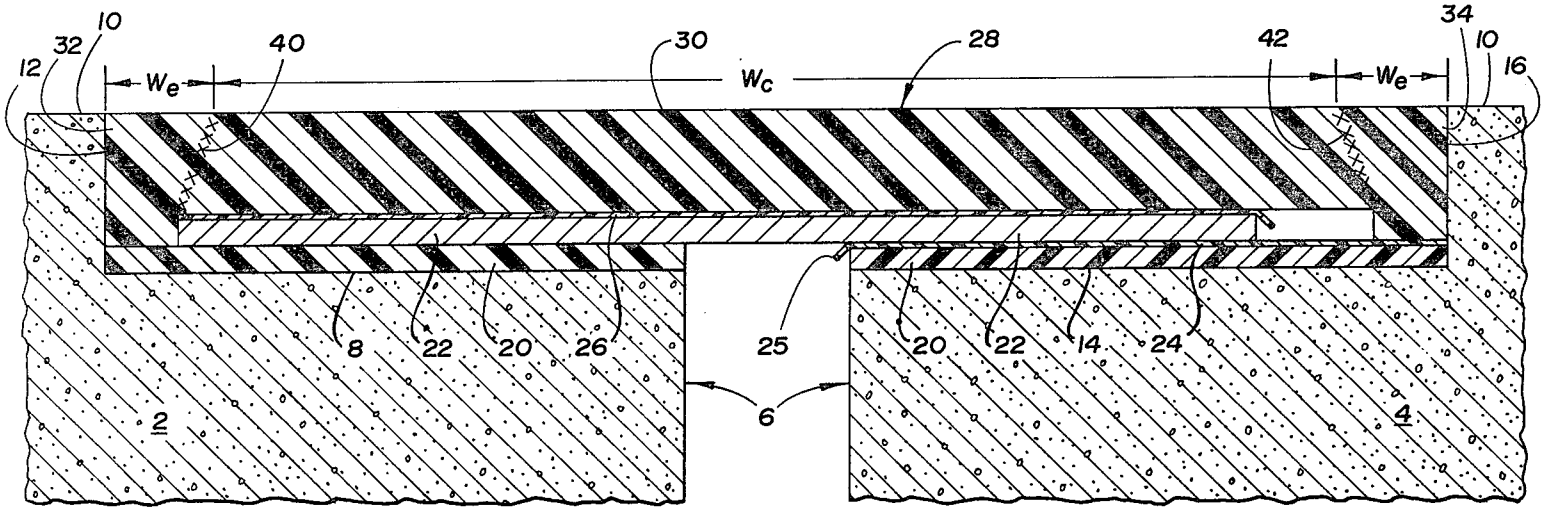
FIG. 1 shows a cross section transverse to the roadway, of a sealed expansion joint embodying and made in accordance with the invention.

Referring now to the drawings, there is shown in FIG. 1 two adjacent concrete roadway sections, 2 and 4, spaced by an expansion slot 6. The edge of the concrete section 2 adjacent slot 6 has a recess, the bottom surface 8 of which is in a plane substantially parallel to the plane of the roadway surface 10, and the side surface 12 of which extends from the roadway surface 10 to the bottom surface 8 of the recess. Concrete section 4 has a like recess, the bottom surface of which is shown at 14 and the side surface which is shown at 16.

The bottom surfaces 8 and 14 of the recesses are covered with a layer 20 of a suitable bedding material which is bonded to and seals the concrete surfaces and separates them from metal plate 22 thereby inhibiting metal-corrosion inducing electrolytic action between the concrete and the metal plate. Metal plate 22 which bridges the slot 6 has one side thereof secured to the bottom surface 8 of the recess in concrete section 2, and the other side thereof—the side of the plate to the other side of the expansion slot 6—is movable relative to the bottom surface 14 of the recess in concrete section 4. Hence, with expansion or contraction of the concrete sections due to changes in temperature, with accompanying narrowing or widening of slot 6, metal plate 22 can slide, as required, with respect to the coated surface 14. To assure free movability of the plate relative to the surface 14, a sheet 24 of a low friction plastic, such as polyethylene, is interposed between the plate and the coated surface 14. The inner edge 25 of this sheet can simply hang into the expansion slot and the remainder of the sheet is secured in the recess by being bonded to the layer 20.

Likewise, overlying the top surface of the metal plate is a like sheet of plastic 26, this sheet separating the metal plate from the elastomeric slab, now to be described, and hence better enabling freedom of movement therebetween.

The remainder of the recesses is filled with a unitary elastomeric slab 28, the upper surface of which is aligned or co-planar with the roadway surface 10 and the sides of which are bonded to the side surfaces 12 and 16 of the recesses. The elastomeric slab has a center portion 30 which is premolded and which has relatively high elasticity, and edge portions 32 and 34 which are molded in situ and which are of relatively low elasticity. The width $W_e$ of each of the edge portions (i.e. the width transverse to the slot) at the upper surface thereof should preferably be from about one-half to three-quarter inch and the width $W_c$ of the center portion (transverse to the slot) at its top surface should preferably be from 4 to 12 inches. In the embodiment shown $W_c$ is 6 inches and $W_e$ is one-half inch, the width of the expansion slot 6 being three-quarter inch.

Also, in the preferred embodiment shown, the low elasticity, or relatively hard, edge portions 32 and 34 of the elastomeric slab are tapered or wedge-shaped, in transverse section shown, with the top of each of these edge portions being of greater width than the bottom. The following are the preferred physical properties for the center and edge portions of the elastomeric slab:

Center portion: durometer elasticity on the Shore A scale, 25–40; tensile strength, 200–400 psi; elongation, 400–800%.

Edge portions: durometer elasticity on the Shore A scale, 70–95; tensile strength, 800–3000 psi; elongation, 50–300%.

As has been indicated, by reason of this difference in physical properties and with the center portion of the unitary elastomeric slab being of a relatively high elasticity and the edge portions being of relatively low elasticity, there is excellent accommodation for expansion and contraction of the concrete sections—this because the elastomeric slab can undergo elongation or compression—and yet with the elastomeric slab providing great resistance against deterioration of the bond between the elastomeric slab and the concrete from the mechanical pounding thereagainst from overpassing vehicle wheels—this because of the relative hardness of the edge portions which resists excessive deformation from the forces applied by the vehicle wheels. The preferred material for both the center and edge portions of the elastomeric slab is polyurethane elastomer, the center portion being premolded and being formulated of a polyurethane elastomer having the relatively high elasticity and other properties specified above for the center portion, and the edge portions being molded in situ and formulated of a polyurethane elastomer having relatively low elasticity and the other properties specified above for the edge portions. Because the tire elastomeric slab is of unitary construction, as distinguished from separate center and edge bodies mechanically bonded or adhered together by an adhesive, there is no possibility of water leakage through the slab and, in accordance with the invention, ample protection is rendered to the bond between the slab and concrete.

Further details with respect to the structure and the compositions used therein will be apparent from the following description of the preferred method for forming the structure.

In constructing the roadway the concrete section edge portions adjacent the expansion slot are, of course, formed to provide recesses as shown. The bottom surfaces of these recesses are provided with the bedding compound layer, preferably a polyurethane elastomer composition, which can, for example, be the same as that of the edge portions of the elastomeric slab. The bedding layer can be applied as a paste-like coating on surfaces 10 and 14 and then allowed to cure in situ after locating the metal plate as hereinafter described.

With the layer of bedding material 20 having been applied, but yet uncured and hence tacky, the sheet 24 of polyethylene or the like is placed over the layer of bedding material on surface 14, the inner edge 25 of this sheet being simply allowed to droop into the expansion slot 6, and the metal plate 22 (preferably of aluminum because of its corrosion resistant properties) is located, as shown, so as to bridge the expansion slot 6. The side of the plate within the recess in concrete section 2 is secured to the bottom surface 8 of that recess by becoming bonded to the bedding material before it cures. The other side of the plate overlies the polyethylene sheet 24 and is free, during expansion and contraction of the concrete sections 2 and 4, to move relative to coated surface 14. To enable this, the width of the plate 22 is such as to provide a substantial gap between the end of the plate within the recess in concrete section 4 and the side wall 16 of that recess. After the metal plate is thus secured, the other sheet 26 of polyethylene or the like is laid down over the entire top surface of the metal plate, the end of this sheet at the free end of the metal plate being allowed to droop over the end of the plate as shown.

Figure 2:
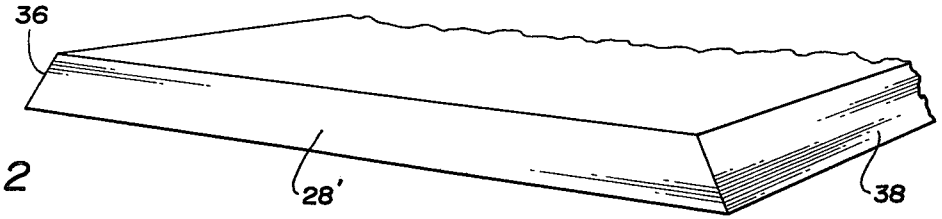
FIG. 2 shows a perspective view, with parts broken away, of a portion of the elastomeric slab which forms a part of the sealed expansion joint shown in FIG. 1.

Next, in accordance with the preferred method for forming the sealed joint structure, a premolded cured body 28' of polyurethane elastomer of relatively high elasticity preferably formed of a polyurethane elastomer having properties specified above for the center portion of the elastomeric slab, is placed over the polyurethane sheet. Such body is shown in FIG. 2, the thickness of this elastomeric body is such that the top surface thereof is aligned or coplanar with the roadway surface. As best shown in FIG. 2, the elastomeric body is of uniform thickness, with tapered sides 36 and 38, the upper surface of the body being of lesser width than the bottom surface.

With the elastomeric body 28' so positioned over the polyethylene sheet 26, the side surfaces 36 and 38 of the elastomeric body and the sides 12 and 16 of the recesses are coated with a thin layer of a polyurethane primer and then a soft paste-like or semi-liquid uncured polyurethane composition is molded in situ to fill the entire edge portions of the recesses thereby forming edge portions 32 and 34 of the elastomeric slab.

The following are formulations useful for the center and the edge portions of the elastomeric slab, for the bedding material, and for the primer.

| TYPICAL FORMULATION FOR PREMOLDED CENTER PORTION OF ELASTOMERIC SLAB | | |
|---|---|---|
| Hydroxyl Component - 140 parts by weight | | |
| 5000-6000 Molecular Weight | | |
| Polyether Triol | 100.0 | parts by weight |
| Magnesium Aluminum Silicate | 25.0 | parts by weight |
| Titanium Dioxide | 15.0 | parts by weight |
| Antioxidant (Ionol) | 0.5 | parts by weight |
| Catalyst (Butyl Tin Laurate) | 0.5 | parts by weight |
| Isocyanate Component - 90 parts by weight | | |
| 3000 Molecular Weight | | |
| Polyether Triol | 100.0 | parts by weight |
| 80/20 Mixture 3,4/2,6 | | |
| Toluene Diisocyanate | 17.4 | parts by weight |
| Decyl Alcohol | 4.3 | parts by weight |

| TYPICAL FORMULATION OF PRIMER | | |
|---|---|---|
| Hydroxyl Component - 1 part by volume | | |
| 1000 Molecular Weight | | |
| Polyether Triol | 60.0 | parts by weight |
| Polyurethane Grade Solvent | 40.0 | parts by weight |
| Isocyanate Component - 1 part by volume | | |
| Commercially available | | |
| Isocyanate | | |
| Prepolymer in Xylol | | |
| Solvent - Resin | 60.0 | parts by weight |
| - Xylol | 40.0 | parts by weight |

Specifications on the prepolymer are:

| | |
|---|---|
| Total Solids | 60.0% by weight |
| Percent NCO | 11.5% by weight |
| Percent Free TDI | less than 1.0% by weight |

| TYPICAL FORMULATION FOR EDGE PORTIONS OF ELASTOMERIC SLAB AND FOR THE BEDDING MATERIAL | | |
|---|---|---|
| Hydroxyl Component - 157 parts by weight | | |
| 5000 Molecular Weight | | |
| Polyether Triol | 100.0 | parts by weight |
| Thixotrope - Bentone* | 11.0 | parts by weight |
| Magnesium Aluminum Silicate | 26.0 | parts by weight |
| Titanium Dioxide | 19.0 | parts by weight |
| Antioxidant - Ionol | 0.5 | parts by weight |
| Catalyst Butyl Tin Laurate | 0.5 | parts by weight |
| Isocyanate Component - 70 parts by weight | | |
| 3000 Molecular Weight | | |
| Polyether Triol | 100.0 | parts by weight |
| 80/20 Mixture 2,4/2,6 | | |
| Toluene Diisocyanate | 17.4 | parts by weight |
| Decyl Alcohol | 4.3 | parts by weight |

*Trademark of NL Industries

As well known by those skilled in the art, in the case of each of the formulations specified above, each component of the formulation is separately premixed and then the two components are mixed together just prior molding, in the case of center and edge portions of the slab, or just prior to application to the surfaces specified, in the case of the primer and bedding material. As has already been indicated, the center portion of the elastomeric slab is premolded and cured, in a plant or shop, by conventional molding techniques to provide a molded body such as shown in FIG. 2, and the edge portions of the elastomeric slab are molded in situ as described, the curing of such edge portions and the bedding material and primer being in situ in the formed, sealed joint. By premolding the center portion excellent dimensional control, as to thickness and otherwise, can be attained thereby to assure a uniform and proper thickness for the slab to the end that its upper surface is flat and coplanar with the road surface.

Particularly by way of use of the primer, the molded in situ edge portions 32 and 34 chemically bond to the center portion 28 thereby to provide the desired unitary elastomeric slab, the location of this chemical bonding being shown at 40 and 42 in FIG. 1, these junctions 40 and 42 between the center portion and edge portions being tapered toward the center of the slab from bottom to top of the slab as shown. Likewise there is excellent strong chemical bonding of the edge portions of the unitary elastomeric slab to the surfaces 12 and 16 of the recesses. The end result is a sealed expansion joint structure which is very durable and hence provides long term assurrance against the entrance of water or road debris into the expansion slot while at the same time enabling free expansion and contraction of the concrete sections without deformation of the shape of the elastomeric slab.

It will be understood that while the invention has been described in its particulars with reference to the preferred embodiment, various changes and modifications may be made all within the full and intended scope of the claims which follow.

What is claimed is:

1. In a roadway having concrete sections with upper surfaces aligned to form the roadway surface and spaced from each other to provide an expansion slot, each concrete section having at the end thereof adjacent said slot a recess which extends longitudinally of the slot and which has a bottom surface generally parallel to the roadway surface and a side surface extending from said bottom surface to the roadway surface;

a metal plate bridging said slot, said metal plate being secured to the bottom surface of one of said recesses and being movable relative to the bottom surface of the other of said recesses; and a unitary elastomeric slab above said metal plate and bridging said slot, said elastomeric slab having an upper surface aligned with the upper surface of said concrete sections and having edge surfaces bonded to the side surfaces of said recesses, said elastomeric slab having a premolded center portion of relatively high elasticity and having edge portions which are molded in situ and which are of relatively low elasticity.

2. A roadway as set forth in claim 1 wherein the premolded center portion of said elastomeric slab has a durometer elasticity on the Shore A scale of from 25 to 40 and wherein the edge portions of said elastomeric slab have a durometer elasticity on the Shore A scale of from 70 to 95.

3. A roadway as set forth in claim 1 wherein the width of each of said edge portions at the upper surface thereof and in a direction transverse to the slot is from about $\frac{1}{2}$ to $\frac{3}{4}$ inch and wherein the width of said center portion at the upper surface thereof and in a direction transverse to the slot is from about 4 to 12 inches.

4. A roadway as set forth in claim 1 wherein the bottom surfaces of said recesses are covered with a layer of bedding material, wherein there is a layer of low friction plastic between said metal plate and said elastomeric slab and wherein there is a layer of low friction plastic between the bedding material covering the said other of said recesses and the overlying portion of said metal plate.

5. A roadway as set forth in claim 1 wherein the junctions between the edge portions and the center portion of the elastomeric slab are tapered toward the center of the slab from bottom to top thereof.

6. A roadway as set forth in claim 1 wherein all portions of said elastomeric slab are polyurethane elastomer.

7. In a roadway having concrete sections with upper surfaces aligned to form the roadway surface and spaced from each other to provide an expansion slot, each concrete section having at the end thereof adjacent said slot a recess which extends longitudinally of the slot and which has a bottom surface generally parallel to the roadway surface and a side surface extending from said bottom surface to the roadway surface;

a metal plate bridging said slot, said metal plate being secured to the bottom surface of one of said recesses and being movable relative to the bottom surface of the other of said recesses;

a layer of elastomeric bedding material covering and bonded to the bottom surface of each of said recesses intermediate said plate and said bottom surfaces;

a layer of low friction plastic between the bedding material on the bottom surface of the other of said recesses and said metal plate;

a unitary elastomeric slab above said metal plate and bridging said slot, said elastomeric slab having an upper surface aligned with the upper surfaces of said concrete sections and having edge surfaces bonded to the side surfaces of said recesses, said elastomeric slab having a premolded center portion and having edge portions which are molded in situ; and a layer of low friction plastic between said metal plate and said elastomeric slab;

said center portion of said slab having a durometer elasticity on the Shore A scale of from 25 to 40, a tensile strength of from 200 to 400 psi and elongation of from 400 to 800%; and said edge portions having a durometer elasticity on the Shore A scale of from 70 to 95, a tensile strength of from 800 to 3000 psi and elongation of from 50 to 300%.

8. A method for forming a sealed expansion joint in a roadway having concrete sections with upper surfaces aligned to form a roadway surface and with an expansion slot therebetween, each of the concrete sections having a recess which extends longitudinally of the slot and which has a bottom surface generally parallel to the roadway surface and a side surface extending from the roadway surface to the bottom surface, said method comprising:

securing a metal plate to the bottom surface of one of said recesses with the metal plate bridging the expansion slot and being movable relative to the bottom surface of the other of the recesses;

placing a premolded elastomeric body of relatively high elasticity over the metal plate with the edges of said body being spaced from the side surfaces of said recesses; and molding in situ between the edges of said body and the sides of said recesses edge bodies of elastomeric material of relatively low elasticity thereby to chemically bond said edge bodies to said premolded body to form therewith a unitary elastomeric slab having a center portion of relatively high elasticity and edge portions of relatively low elasticity and with said edge portions being chemically bonded to the sides of said recesses.

9. A method as set forth in claim 8 wherein said premolded elastomeric body has a durometer elasticity on the Shore A scale of from 25 to 40 and wherein said edge bodies have a durometer elasticity on the Shore A scale of from 70 to 95.

10. A method as set forth in claim 8 wherein said premolded elastomeric body has edge surfaces which are tapered toward the center of the body from bottom to top thereof.

11. A method as set forth in claim 8 wherein the premolded elastomeric body and the edge bodies are of polyurethane elastomer.

12. A method as set forth in claim 8 wherein the bottom surfaces of said recesses are coated with an elastomeric bedding material prior to securing said metal plate, said metal plate being secured by bonding it to the coating of bedding material on the surface of said one of said recesses.

13. A method for forming a sealed expansion joint in a roadway having concrete sections with upper surfaces aligned to form a roadway surface and with an expansion slot therebetween, each of the concrete sections having a recess which extends longitudinally of the slot and which has a bottom surface generally parallel to the roadway surface and a side surface extending from the surface to the bottom surface, said method comprising:

coating the bottom surfaces of recesses with an elastomeric bedding material;

placing a sheet of low friction plastic over the coating of bedding material on the bottom surface of one of said recesses; bonding a metal plate to the bedding material on the bottom surface of the other of said recesses with the metal plate bridging the expansion slot and being movable relative to said sheet of low friction plastic;

placing a sheet of low friction plastic over said plate;

placing a premolded elastomeric body over said second-mentioned plastic sheet with the side surfaces of said body being spaced from the side surfaces of said recesses;

coating the side surfaces of said elastomeric body and the side surfaces of said recesses with a thin layer of elastomeric primer; and molding and thereafter curing in situ between the coated side surfaces of said body and the coated side surfaces of said recesses, edge bodies of elastomeric material thereby to chemically bond said edge bodies to the sides of said recesses and to said premolded body to form with said premolded body a unitary elastomeric slab;

said premolded body having a durometer elasticity on the Shore A scale of from 25 to 40 and said cured edge bodies having a durometer elasticity on the Shore A scale of from 70 to 95.

* * * * *